United States Patent [19]

Bartos

[11] Patent Number: 4,615,686

[45] Date of Patent: Oct. 7, 1986

[54] SLOT CAR CHASSIS

[75] Inventor: Stephen P. Bartos, Amherst, Ohio

[73] Assignee: Parma International Inc., North Royalton, Ohio

[21] Appl. No.: 752,292

[22] Filed: Jul. 3, 1985

[51] Int. Cl.[4] ..... A63H 29/22

[52] U.S. Cl. ..... 446/462; 446/446; 446/469; 446/471

[58] Field of Search ..... 446/6, 446, 457, 462, 446/465, 466, 469, 470, 471

[56] References Cited

U.S. PATENT DOCUMENTS

| | | | |
|---|---|---|---|
| 3,176,429 | 4/1965 | Brown et al. | 446/6 |
| 3,596,397 | 8/1971 | Colletti | 46/243 M |
| 3,653,149 | 4/1972 | Prodger et al. | 446/471 |
| 4,466,215 | 8/1984 | Hanazato | 446/471 |
| 4,470,219 | 9/1984 | Sugimoto | 446/471 |

*Primary Examiner*—F. Barry Shay

[57] ABSTRACT

Miniature, remote-controlled, electrically-driven slot cars and, more particularly, a novel dual-chassis assembly therefor.

7 Claims, 7 Drawing Figures

SLOT CAR CHASSIS

The present invention relates to minature, remote-controlled, electrically driven slot cars and, more particularly, to a novel chassis assembly therefor.

BACKGROUND ART

The use of a dual-chassis construction for slot cars is known. Prior U.S. Pat. No. 3,596,397, dated Aug. 3, 1971 and issued to Colletti, describes one such dual-chassis assembly in which a first chassis supports the front and rear wheel axles plus the car body. A second chassis pivots on the rear wheel axle and supports the car remaining components, including the car motor, the pin for contact with the racing car set track, and the contact brushes. Thus, the major weight of the car is supported separate from the chassis on which the wheels are mounted. Since this separate chassis also carries the guide pin and contact brushes, this helps maintain the same in better contact with the car track. Also, pivotally mounting the second chassis on the rear wheel is said to create a moment arm, further increasing contact of the guide pin and brushes with the racing car track.

A principal object of the present invention is to provide a dual-body chassis assembly in which the car body is isolated from road shock and vibration for smoother ride and easier handling. This object is not a part of the U. S. Pat. No. 3,596,397.

DISCLOSURE OF INVENTION

The present invention constitutes an improvement in the art in the provision of a first bottom chassis; front and rear axles mounted on said bottom chassis, each of said axles including a pair of rotatable wheels; an upper body mount plate or second chassis in superimposed relationship to said bottom chassis including means adjacent the front axle hinging the upper body mount plate to the bottom chassis; electric motor drive means supported by said bottom chassis and operatively driving said rear axle; said bottom chassis including means engaging the upper body mount plate at a point rearward of the front axle permitting limited sideways and vertical movement of the body mount plate relative to the bottom chassis.

Preferably, the means engaging hinging the upper body mount plate to the bottom chassis also permits limited sideways and vertical movement of the front of the body mount plate relative to the bottom chassis.

By mounting the car body on one chassis, and the front and rear wheel axles on a second chassis, and permitting limited sidways and vertical movement of the two chassis relative each other, the car body is isolated from road shock and vibration for a smoother ride and easier handling.

In addition, the mode of connection of the two chassis permits a slight roll of the car body during cornering, similar to a full size car, further improving handling.

BRIEF DESCRIPTION OF THE DRAWINGS

The present invention and advantages thereof will become more apparent upon consideration of the following specification, with reference to the accompanying drawings, in which.

BEST MODE FOR CARRYING OUT THE PRESENT INVENTION AND INDUSTRIAL APPLICABILITY

Figure 1:
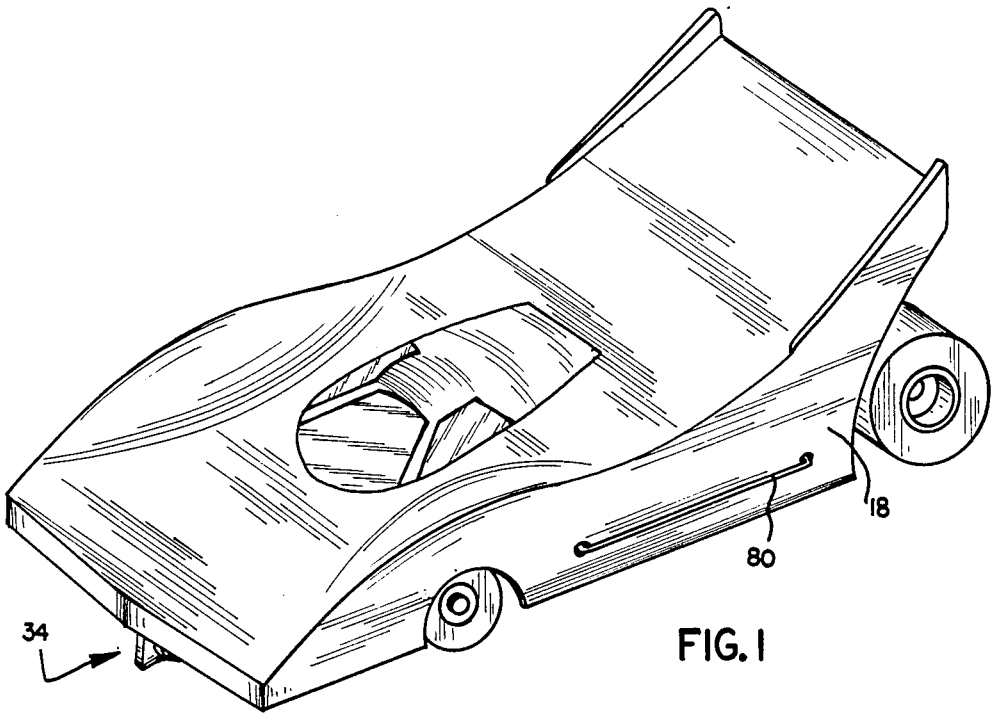
FIG. 1 is a perspective view of a slot car constructed in accordance with the concepts of the present invention.

A slot car of the type with which the present invention is concerned is illustrated in FIG. 1. These cars are primarily designed for racing on commercial tracks open to the public, rather than home racing car sets. Thus, the cars have to be capable, generally, of a higher standard of performance than the conventional home racing car. In addition, the cars must be designed for easy disassembly, repairs, gear modifications and adjustments by the owner.

Figure 2:
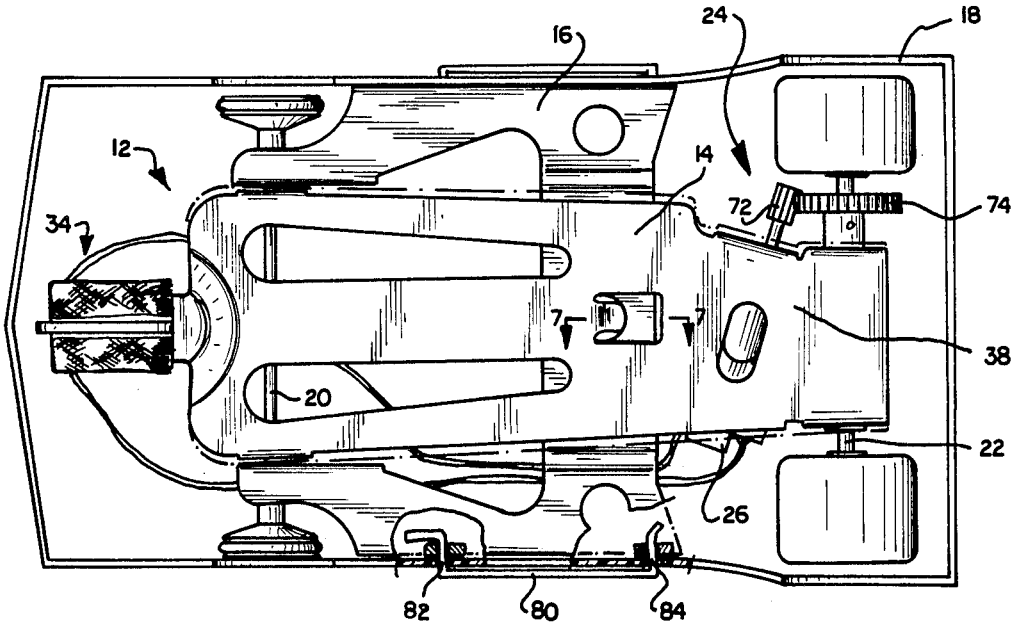
FIG. 2 is a bottom plan view of the slot car of FIG. 1, showing in particular the chassis assembly of the slot car.

A principal object of the present invention resides in the provision of a dual-chassis assembly, illustrated in detail in FIG. 2, and broadly designated with the numeral 12. The chassis assembly includes a first or lower bottom chassis 14 and a second or upper body mount plate or chassis 16, in an upper superimposed relationship with respect to the bottom chassis.

The upper body mount plate 16 is adapted to support the racing car body 18, in a manner to be described, whereas the lower bottom chassis mounts the front and rear wheel axles 20 and 22, respectively, and the car drive train components broadly designated with the numeral 24, including electric motor 26.

A principal feature of the present invention resides in the manner in which the upper body mount plate is coupled to the lower bottom chassis in a way to absorb bumps and roughness in the car racing set track, and at the same time separate the upper body mount plate from the bottom chassis to allow tilting or rolling of the car body as the car corners, in turn giving better handling capabilities. For reference purposes, with regard to dimensions given hereinafter, the overall length of the car is about 6 inches and the overall width is about 3½ inches.

Figure 3:
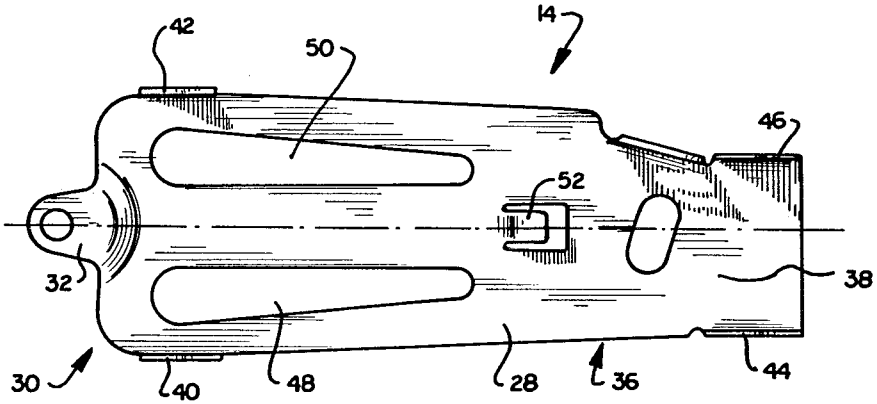
FIG. 3 is a bottom plan view of the bottom chassis of the assembly of FIG. 2.
Figure 4:
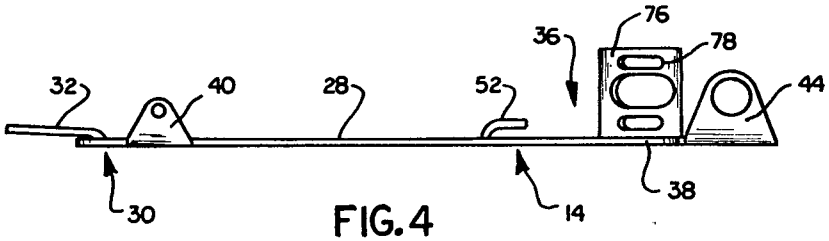
FIG. 4 is a side elevation view of the bottom chassis of FIG. 3.

The lower bottom chassis:

The lower bottom chassis 14 is illustrated principally in FIG. 2–4. This chassis is in the shape of an essentially flat, elongated plate 28, FIG. 3, having longitudinal and width dimensions somewhat less than the car body length and width, as shown in FIG. 2. Preferably, it is inexpensively stamped from 0.036 inch half-hard, cold-rolled steel having a zinc plate finish with blue dye chromate for appearance. At the front end 30 of the bottom chassis, there is provided a nose 32, adapted to pivotally support the car guide pin and brush assembly 34 (FIG. 2), and at the rear end 36 there is a motor mount platform 38, adapted to mount motor 26.

Forward upstanding, triangular side flanges 40 and 42 (FIGS. 3 & 4), positioned slightly behind the nose 32, provide mounts for the car front axle 20. Rearwardly positioned, upstanding triangular side flanges 44 and 46 (FIGS. 3 & 4), outboard of the motor mount platform 38, mount the car rear axle 22.

As shown in FIG. 2, the side flange mounts for the front and rear axles are generally aligned with the longitudinal center line of the bottom chassis. Between the nose 32 and the motor mount platform 38, the chassis bottom plate is generally flat, with sides tapering slightly inwardly going from the front to the back of the chassis. Elongated cutouts 48 and 50 (FIG. 3) are provided along the opposite sides of the plate centerline for weight reduction, and also to give some torque flexibility to the chassis.

Along the centerline, the plate 28 is provided with an upraised tongue 52 extending upwardly from the plane of the plate a distance of about 0.075 inches and rearwardly a distance of about 0.3 inches. The tab is adapted to engage the body mount plate 16 in a manner to be described, the clearance of the tab with the plane of the bottom plate being sufficient to permit small up-and-down movement of the bottom plate without corresponding vibration or movement in the upper body mount plate 16.

This tongue is positioned slightly in front of the rear motor mount platform 38, or about two-thirds of the distance from the front axle to the rear axle of the slot car.

Figure 5:
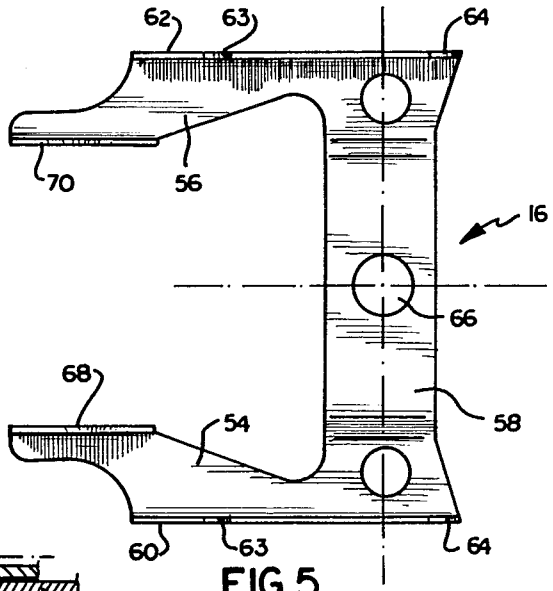
FIG. 5 is a top plan view of an upper body mount plate or second chassis of the assembly of FIG. 2.

Upper body mount plate;

The upper body mount plate 16 (FIGS. 2, 5 & 6) is also generally flat and has a U-shaped configuration (FIG. 5) with forwardly extending arms 54 and 56, and laterally extending bridge 58 at the base of the arms. As with the bottom chassis, the body mount plate is stamped from 0.036 inch, half-hard, cold-rolled steel having a zinc plate finish with blue dye chromate for appearance.

The width of the body mount plate is slightly greater than the width of the bottom chassis, and essentially is the same as that of the car body. The length is about two-thirds of that of the bottom chassis, extending essentially from the front axle, rearwardly, to the tonque referred to above, and as illustrated in FIG. 2.

The opposite sides 60 and 62, of the body mount plate, are in the form of upturned, raised edges having further raised protrusions 63 and 64 (FIG. 6) spaced about 1½ inches apart in front of and behind the lateral center line of the bridge 58. The car body is attached to the body mount plate by means of these protrusions, also in a manner to be described. The exact location of the protrusions is a matter of design and can be varied, depending upon the center of gravity of the various components, rigidity required, and the like.

Figure 7:
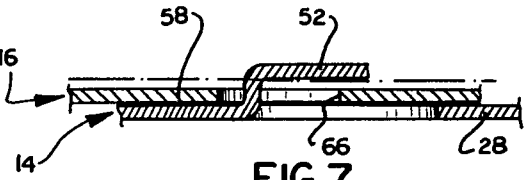
FIG. 7 is an enlarged section view taken through line 7—7 of FIG. 2.

At the intersection of the centerline of the bridge 58, and the longitudinal centerline of the body mount plate, there is provided an aperture 66 (FIG. 5) in which tongue 52 of the bottom chassis rides. The diameter of aperture 66 is dimensioned so as to permit limited sideways movement of the tongue. The tongue, in turn, is dimensioned, as mentioned, to permit limited up-and-down movement of the bottom chassis with regard to the body mount plate. This is illustrated in detail in FIG. 7. The positioning of the tab and aperture also permits slight forward and rearward movement of the two chassis parts relative each other. On the inside of arms 54 and 56, at their forwardmost ends, are triangular upraised flanges 68 and 70 adapted to engage the car front axle 20. The separation of flanges 68 and 70 (FIG. 5) is sufficient to position them slightly outboard of the bottom plate flanges 40 and 42, (which mount the car front axle 20 when both chassis parts are assembled together in their superimposed relationship shown in FIG. 2.). This separation distance (about 0.03 inches on each side) also is sufficient to permit limited sideways movement of the bottom chassis, in the front, without corresponding movement of the body mount plate. In this regard, the amount of sideways movement of the two chassis parts, relative to each other, at the front on axle 20, is about the same as at the rear between tongue 52 and aperture 66. This side-to-side play is illustrated by the use of broken lines in FIG. 2.

Also, the openings 71 (FIG. 6) in the flanges 68 and 70 are slightly larger or oversized compared to those in the flanges 40 and 42, accommodating the front axle 20, allowing some additional play or movement of the body mount plate 16 relative to the front axle. Specifically, the openings, to accommdate the axle in flanges 40 and 42, are about 0.068 inches in diameter, whereas those in flanges 68 and 70 are about 0.076 inches in diameter. The up-and-down movement of the front axle 20 relative to the body mount plate, however, is less than that permitted by tongue 52.

From the above, it is apparent that the body mount plate is floatingly connected to the bottom chassis by means of the car front axle, at the front, and by means of a single tab at the rear permitting limited up-and-down and sideways movement of the bottom chassis and car axles relative to the body mount plate.

In this way, the complete assembly allows the upper body mount plate to float with a hinging, tilting and side-to-side movement which absorbs the bumps and roughness of the track surface. In addition, the separation of the body away from the bottom chassis is such as to allow tilting of the car body as the car corners, similar to a full size car, in turn attributing to better handling capabilities.

Although a preferred embodiment of the present invention is hinging the body mount plate on the front axle, for the purpose of economy, essentially the same "floating" advantage can be achieved by hinging the body mount plate on said mounted pins, aligned with the car front axle, but connected to the bottom chassis in an area in front of or behind, but adjacent, the front axle.

Other features of the present invention:

Referring to FIG. 2, the drive train components as mentioned include motor 26 mounted on the motor mount platform 38, at an angle of about 15° with respect to the rear axle. The motor is connected to a pinion gear 72 which, in turn, engages spur gear 74 fastened to the rear axle 22. The arrangement permits the use of relatively small diameter gears without interference with the car rear axle. The small diameter gears are important to permit the use of small diameter wheels, which lowers the center of gravity of the car.

The angle mounting of the motor allows for better weight transfer during acceleration and breaking, giving fore and aft weight transfer rather than side-to-side transfer, in turn providing better handling during operation.

The motor is mounted on a vertically extending flange 76 (FIG. 4) of the bottom chassis, positioned in front of the rear axle. As shown, the mounting openings in the flange are in the form of slots 78, allowing for adjustment of the motor position for optimum gear mesh.

Figure 6:
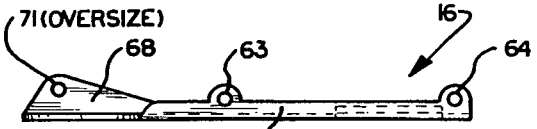
FIG. 6 is a side elevation view of the upper body mount plate of FIG. 5.

Above, it was pointed out that the car body is affixed to the car body mount plate using the openings in protrusions 63 and 64 (FIG. 6). Although the connection can be made by screws or bolts, it is an aspect of the present invention that the car body is very simply attached and clipped to the protrusions by means of small wire clips 80, shown in FIG. 2. These clips have an ell-shaped hook 82 at one end, which fits in one opening, and a flexible S-shaped snap 84 at the other end, which fits into the second opening. This, and other aspects of the car provide very easy assembly of the car, including ease of removal of components for repair and maintenance.

It is a principal feature of the present invention that the main chassis components are easily stamped from sheet metal. This provides a construction which is very inexpensive on the one hand but which has the handling characteristics of a much more expensive or custom made construction on the other hand.

I claim:

1. A slot car for use on a track having a guide slot comprising (a) a first bottom chassis;

(b) front and rear axles mounted on said bottom chassis, each of said axles including a pair of rotatable wheels;

(c) an upper body mount plate in superimposed relationship to said bottom chassis including hinging means adjacent the front axle hinging the body mount plate to the bottom chassis;

(d) electric motor drive means mounted on said bottom chassis and operatively engaging said rear axle;

(e) said bottom chassis including connecting means at a point rearward of the front axle engaging the body mount plate for connecting said bottom chassis to said body mount plate while permitting limited sideways and vertical movement of the bottom chassis relative to the body mount plate.

2. The slot car of claim 1 wherein said hinging means comprises flange portions engaging said front axle.

3. The slot car of claims 1 or 2 wherein said connecting means comprises tab means on either the bottom chassis or body mount plate engaging aperture means in the other.

4. The slot car of claim 3 wherein said tab means and aperture means are located along the longitudinal axis of the car, said hinging means being at two locations on opposite sides of said axis.

5. The slot car of claim 2 wherein said flange portions have oversized openings allowing play between the axle and body mount plate.

6. The slot car of claims 1 or 2 wherein said bottom chassis and upper body mount plate are stamped sheet metal parts.

7. A slot car for use on a track having a guide slot comprising (a) a first bottom chassis;

(b) front and rear axles;

(c) front and rear side flange means on said bottom chassis;

(d) an upper body mount plate is superimposed relationship to said bottom chassis including flange means for hinging said body mount plate on said front axle, said body mount plate flange means being spaced relative to the bottom chassis side flange means to permit limited sideways and vertical movement of the front of the bottom chassis relative to the front of the body mount plate; and (e) said bottom chassis including connecting means at a point rearward of the front axle engaging the body mount plate for connecting said bottom chassis to said body mount plate while permitting limited sideways and vertical movement of the rear of the bottom chassis relative to the rear of the body mount plate.

* * * * *